US006831045B2

(12) United States Patent
Shimomura et al.

(10) Patent No.: US 6,831,045 B2
(45) Date of Patent: Dec. 14, 2004

(54) REFRIGERATING MACHINE OIL COMPOSITION

(75) Inventors: Yuji Shimomura, Yokohama (JP); Katsuya Takigawa, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 146 days.

(21) Appl. No.: 10/333,679

(22) PCT Filed: Jul. 18, 2001

(86) PCT No.: PCT/JP01/06240

§ 371 (c)(1),
(2), (4) Date: Jan. 23, 2003

(87) PCT Pub. No.: WO02/08367

PCT Pub. Date: Jan. 31, 2002

(65) Prior Publication Data

US 2003/0146407 A1 Aug. 7, 2003

(30) Foreign Application Priority Data

Jul. 24, 2000 (JP) ..... P2000-222755

(51) Int. Cl.[7] ..... C10M 105/36; C10M 105/38
(52) U.S. Cl. ..... 508/116; 252/68
(58) Field of Search ..... 508/116; 252/68

(56) References Cited

U.S. PATENT DOCUMENTS 4,623,473 A * 11/1986 Davis et al. ..... 508/335

FOREIGN PATENT DOCUMENTS

| | | | |
|---|---|---|---|
| JP | 03-128991 | | 5/1991 |
| JP | 3-505602 | | 12/1991 |
| JP | 08-134481 | | 5/1996 |
| JP | 09-221690 | | 8/1997 |
| JP | 2001-49275 | | 2/2001 |
| WO | WO 88/02771 | * | 4/1988 |
| WO | WO 90/12849 | | 11/1990 |
| WO | WO 97/21792 | | 6/1997 |
| WO | WO 00/58425 | | 3/1999 |
| WO | WO 00/58424 | | 8/1999 |
| WO | WO 01/02517 | | 8/1999 |
| WO | WO 00/58426 | | 5/2000 |
| WO | WO 01/05740 | | 7/2000 |

* cited by examiner

*Primary Examiner*—John Hardee
(74) *Attorney, Agent, or Firm*—Finnegan, Henderson, Farabow, Garrett & Dunner, LLP

(57) ABSTRACT

The refrigerating machine oil composition of the present invention is a refrigerating machine oil composition comprising an alicyclic dicarboxylic acid ester compound containing an alicyclic ring and two ester groups represented by the following general formula (1):

$$—COOR^1 \quad (1)$$

where $R^1$ represents a hydrocarbon group of 1–30 carbons, the two ester groups bonded to mutually adjacent carbon atoms on the alicyclic ring, wherein the molar ratio of cis-forms and trans-forms for the orientation of the two ester groups of the alicyclic dicarboxylic acid ester compound is from 20/80 to 80/20. When used together with HFC refrigerants and natural refrigerants such as carbon dioxide and hydrocarbons, it can yield a refrigerant machine oil composition with excellent lubricity, miscibility with refrigerants, heat and hydrolytic stability and electric insulating property, which can also provide high efficiency to refrigeration systems.

5 Claims, No Drawings

REFRIGERATING MACHINE OIL COMPOSITION

TECHNICAL FIELD

The present invention relates to a refrigerating machine oil composition, and specifically it relates to a refrigerating machine oil composition comprising an alicyclic dicarboxylic acid ester compound.

BACKGROUND ART

In recent years, the issues of refrigerant substitution and refrigerating system efficiency improvement have been studied from the standpoint of minimizing ozone layer destruction and global warming. In the area of refrigerant substitutes, progress is being made in the substitution of HFCs (hydrofluorocarbons) for chlorine-containing refrigerants such as CFCs (chlorofluorocarbons) and HCFCs (hydrochlorofluorocarbons). On the other hand, since HFC refrigerants could be subject to restrictions in light of the problem of global warming, natural refrigerants such as carbon dioxide, ammonia and hydrocarbons are also being researched for applied use.

Efforts toward such refrigerant substitution are advancing in parallel with development of refrigerating machine oils for these substitute refrigerants. Refrigerating machine oils must satisfy a number of performance requirements including lubricity, miscibility with refrigerants, heat and hydrolytic stability, electric insulating property and low hygroscopicity, and therefore compounds satisfying these requirements are selected to match the type and purpose of use of each refrigerant. Examples of refrigerating machine oils used for HFCs include oxygen-containing compounds such as esters, ethers and carbonates that are miscible with the refrigerants, and alkylbenzenes which have inferior miscibility with the refrigerants but have excellent lubricity and heat and hydrolytic stability.

At the same time, efforts are being made to lower the viscosity of refrigerating machine oils with the goal of achieving higher efficiency of refrigerating systems. Known ester-based refrigerator machine oils include polyol esters obtained by reaction of aliphatic polyhydric alcohols and fatty acids, as disclosed in Japanese Translation Publication No. HEI 3-505602 (JP-A 3-505602) of International Publication for Patent Application and Japanese Patent Kokai (Laid-Open) Publication No. HEI 3-128991 (JP-A 3-128991), and for reduction of the viscosity of such ester-based refrigerating machine oils it has been found effective to select fatty acids with low carbon number alkyl groups for use in the raw material. However, fatty acids with lower alkyl groups generally produce the undesirable situation of low heat and hydrolytic stability of the obtained esters.

There are also known alicyclic polycarboxylic acid esters, such as disclosed in Japanese Patent Kokai (Laid-Open) Publication No. HEI 9-221690 (JP-A 9-221690), as ester-based refrigerating machine oils with excellent heat and hydrolytic stability, but those with a large number of carbon atoms in the terminal alkyl group at the ester site have insufficient miscibility with refrigerants, while those with a small number of carbon atoms in the terminal alkyl group have inferior heat and hydrolytic stability, as well as insufficient lubricity.

There has yet to be developed, therefore, an ester-based refrigerating machine oil that has low viscosity and high lubricity for high efficiency, together with heat and hydrolytic stability and miscibility with refrigerants, while also satisfying the other required aspects of performance.

DISCLOSURE OF THE INVENTION

It is an object of the present invention, which has been accomplished in light of the aforementioned problems of the prior art, to provide a refrigerating machine oil composition which has excellent lubricity, refrigerant miscibility, heat and hydrolytic stability and electrical insulating property and which also increases the efficiency of refrigerating systems, when used together with HFC refrigerants or natural refrigerants such as carbon dioxide and hydrocarbons.

As a result of diligent research aimed at achieving this object, the present inventors have completed the present invention upon finding that the aforementioned problems are solved by a refrigerant oil composition comprising an alicyclic dicarboxylic acid ester compound with two ester groups bonded to mutually adjacent carbon atoms on the alicyclic ring, wherein the ratio of cis-forms and trans-forms for the orientation of the two ester groups of the alicyclic dicarboxylic acid ester compound is controlled to be within a specific range.

Namely, the refrigerating machine oil composition of the invention is a refrigerating machine oil composition comprising an alicyclic dicarboxylic acid ester compound containing an alicyclic ring and two ester groups represented by the following general formula (1):

$$-COOR^1 \quad (1)$$

where $R^1$ represents a hydrocarbon group of 1–30 carbons, the two ester groups bonded to mutually adjacent carbon atoms on the alicyclic ring, wherein the molar ratio of cis-forms and trans-forms for the orientation of the two ester groups of the alicyclic dicarboxylic acid ester compound is from 20/80 to 80/20.

Moreover, in the refrigerating machine oil composition of the present invention, the molar ratio of cis-forms and trans-forms for the orientation of the two ester groups of the alicyclic dicarboxylic acid ester compound is preferably from 25/75 to 75/25, more preferably from 30/70 to 90/30.

In addition, the refrigerating machine oil composition of the present invention preferably also comprises at least one selected from the group consisting of phosphoric acid esters, acidic phosphoric acid esters, amine salts of acidic phosphoric acid ester, chlorinated phosphoric acid esters and phosphorous acid esters.

In addition, the refrigerating machine oil composition of the present invention preferably also comprises at least one selected from the group consisting of phenylglycidyl ether-type epoxy compounds, alkylglycidyl ether-type epoxy compounds, glycidyl ester-type epoxy compounds, allyloxirane compounds, alkyloxirane compounds, alicyclic epoxy compounds, epoxidized fatty acid monoesters and epoxidized vegetable oils.

BEST MODE FOR CARRYING OUT THE INVENTION

A preferred mode for the present invention will now be explained in detail.

The refrigerating machine oil composition of the invention is a refrigerating machine oil composition comprising an alicyclic dicarboxylic acid ester compound containing an alicyclic ring and two ester groups represented by the following general formula (1):

$$—COOR^1 \quad (1)$$

where $R^1$ represents a hydrocarbon group of 1–30 carbons, the two ester groups bonded to mutually adjacent carbon atoms on the alicyclic ring, wherein the molar ratio of cis-forms and trans-forms for the orientation of the two ester groups of the alicyclic dicarboxylic acid ester compound is from 20/80 to 80/20.

The alicyclic ring referred to here may be a cyclopentane ring, cyclopentene ring, cyclohexane ring, cyclohexene ring, cycloheptane ring, cycloheptene ring or the like, but is preferably a cyclohexane ring or cyclohexene ring. A cyclohexane ring is preferred among these because of its low rise in viscosity during use under prolonged and severe conditions, while a cyclohexene ring is even more preferred because of its low rise in total acid value during use under prolonged and severe conditions.

An alicyclic dicarboxylic acid ester compound according to the invention comprises the aforementioned alicyclic, ring and two ester groups represented by formula (1) above. If only one ester group is present, the miscibility with refrigerants and the heat and hydrolytic stability are insufficient, whereas if three ester groups are present, the low temperature flow properties are insufficient.

The two ester groups represented by formula (1) must also be bonded to mutually adjacent carbon atoms on the alicyclic ring. If they are not bonded to mutually adjacent carbon atoms on the alicyclic ring, the heat and hydrolytic stability and the lubricity are inadequate.

An alicyclic dicarboxylic acid ester compound according to the invention includes both the cis- and trans-forms for the orientation of the two adjacent ester groups represented by formula (1), but according to the invention, the molar ratio of the cis-forms and trans-forms is from 20/80 to 80/20, preferably from 25/75 to 75/25 and more preferably from 30/70 to 70/30. If the molar ratio of cis-forms and trans-forms is smaller than 20/80 it is not possible to obtain high lubricity, whereas if it is greater than 80/20 it is not possible to obtain high heat and hydrolytic stability. As will be explained hereunder, one alicyclic dicarboxylic acid ester compound according to the invention may be used alone, or a mixture of two or more thereof may be used; however, when a refrigerating machine oil composition of the invention comprises two or more different types of alicyclic dicarboxylic acid esters, the molar ratio of the cis-forms and trans-forms refers to the molar ratio of the total cis-forms and total trans-forms in the composition.

$R^1$ in formula (1) represents a hydrocarbon group of 1–30, preferably 2–24 and more preferably 3–18 carbons. The hydrocarbon group referred to here may be an alkyl group, alkenyl group, cycloalkyl group, alkylcycloalkyl group, aryl group, alkylaryl group, arylalkyl group or the like. Preferred among these are alkyl group, cycloalkyl group and alkylcycloalkyl group from the standpoint of heat and hydrolytic stability.

The alkyl group may be straight or branched chain alkyl group, and as specific examples there may be mentioned straight or branched chain propyl group, straight or branched chain butyl group, straight or branched chain pentyl group, straight or branched chain hexyl group, straight or branched chain heptyl group, straight or branched chain octyl group, straight or branched chain nonyl group, straight or branched chain decyl group, straight or branched chain undecyl group, straight or branched chain dodecyl group, straight or branched chain tridecyl group, straight or branched chain tetradecyl group, straight or branched chain pentadecyl group, straight or branched chain hexadecyl group, straight or branched chain heptadecyl group and straight or branched chain octadecyl group.

Among these, preferred straight chain alkyl groups are those with 4 or more carbons from the standpoint of heat and hydrolytic stability, and those with no more than 18 carbons from the standpoint of refrigerant miscibility. Preferred branched alkyl groups are those with 3 or more carbons from the standpoint of heat and hydrolytic stability, and those with no more than 18 carbons from the standpoint of refrigerant miscibility.

As cycloalkyl group there may be mentioned cyclopentyl group, cyclohexyl group, cycloheptyl group and the like, with cyclohexyl group being preferred from the standpoint of heat and hydrolytic stability. An alkylcycloalkyl group is one having an alkyl group bonded to a cycloalkyl group, and those with alkyl groups bonded to cyclohexyl group are preferred from the standpoint of heat and hydrolytic stability. Preferred alkylcycloalkyl groups are also those with a total of 6 or more carbons from the standpoint of heat and hydrolytic stability, and those with no more than a total of 10 carbons from the standpoint of refrigerant miscibility and low temperature flow properties.

An alicyclic dicarboxylic acid ester compound according to the invention can be obtained by the production process described below, using a monohydric alcohol ($R^1OH$, where $R^1$ has the same definition as $R^1$ in formula (1) above) and an alicyclic dicarboxylic acid or its acid anhydride with two carboxyl groups on mutually adjacent carbon atoms on the alicyclic ring. According to the invention, the two $R^1$ groups of the alicyclic dicarboxylic acid ester compound may be the same or different, but the alcohol component used preferably includes, (a) at least one type of alcohol selected from the group consisting of aliphatic alcohols of 1–5 carbons, and (b) at least one type of alcohol selected from the group consisting of aliphatic alcohols of 6–18 carbons, in order to obtain adequate heat and hydrolytic stability and lubricity, as well as excellent refrigerant miscibility. When only one type of alcohol from (a) above is used, the obtained alicyclic dicarboxylic acid ester compound tends to have inferior heat and hydrolytic stability as well as insufficient lubricity. When only one type of alcohol from (b) above is used, the obtained alicyclic dicarboxylic acid ester compound tends to have insufficient refrigerant miscibility.

While the alicyclic dicarboxylic acid ester compound according to the invention is preferably obtained using two or more different alcohols, it is particularly preferred to use both an alcohol from (a) and an alcohol from (b) above. Even if two or more different alcohols from (a) alone are used, the obtained alicyclic dicarboxylic acid ester compound tends to have inferior heat and hydrolytic stability, and insufficient lubricity. Also, even if two or more different alcohols from (b) alone are used, the obtained alicyclic dicarboxylic acid ester compound tends to have insufficient miscibility with refrigerants.

In an alicyclic dicarboxylic acid ester compound obtained using the aforementioned alcohol components (a) and (b), the $R^1$ derived from the aliphatic alcohol (a) is an alkyl group of 1–5 carbons, but is preferably an alkyl group of 3–5 carbons from the standpoint of heat and hydrolytic stability. The alkyl group of 1–5 carbons may be straight or branched chain alkyl group, but straight chain alkyl group is preferred from the standpoint of lubricity, while branched chain alkyl group is preferred from the standpoint of refrigerant miscibility and heat and hydrolytic stability.

As specific examples of alkyl groups of 1–5 carbons derived from the alcohol component (a) there may be mentioned methyl group, ethyl group, straight or branched chain propyl group, straight-or branched chain butyl group, straight or branched chain pentyl group and the like, among which n-butyl group and n-pentyl group are preferred from the standpoint of lubricity, while iso-butyl group and iso-pentyl group are preferred from the standpoint of heat and hydrolytic stability.

Furthermore, in an alicyclic dicarboxylic acid ester compound obtained using alcohol components (a) and (b), the $R^1$ derived from the aliphatic alcohol (b) is an alkyl group of 6–18 carbons but is preferably an alkyl group of 6–12 carbons, and more preferably an alkyl group of 7–9 carbons, from the standpoint of miscibility. The alkyl group of 6–18 carbons may be straight or branched chain alkyl group, but straight chain alkyl group is preferred from the standpoint of lubricity, while branched chain alkyl group is preferred from the standpoint of miscibility and heat and hydrolytic stability. Alkyl group with more than 18 carbons is not preferred because they result in inferior refrigerant miscibility and low temperature flow properties.

As specific examples of alkyl group of 6–18 carbons derived from the alcohol component (b) there may be mentioned straight or branched chain hexyl group, straight or branched chain heptyl group, straight or branched chain octyl group, straight or branched chain nonyl group, straight or branched chain decyl group, straight or branched chain undecyl group, straight or branched chain dodecyl group, straight or branched chain tridecyl group, straight or branched chain tetradecyl group, straight or branched chain pentadecyl group, straight or branched chain hexadecyl group, straight or branched chain heptadecyl group and straight or branched chain octadecyl group, among which n-heptyl group, n-octyl group, n-nonyl group and n-decyl group are preferred from the standpoint of lubricity and miscibility, while iso-heptyl group, 2-ethylhexyl group and 3,5,5-trimethylhexyl group are preferred from the standpoint of both miscibility and heat and hydrolytic stability.

Preferred alicyclic dicarboxylic acid ester compounds according to the invention are ester compounds obtained using alcohols of the aforementioned (a) components and alcohols of the aforementioned (b) components, and they include the following.

(A) Esters wherein one of the two ester groups represented by general formula (1) in the game molecule is a group derived from an (a) component, and the other is a group derived from a (b) component;

(B) Mixtures of esters wherein the two ester groups represented by general formula (1) present in the same molecule are both groups derived from (a) components, and esters wherein the two ester groups represented by general formula (1) present in the same molecule are both groups derived from (b) components;

(C) Mixtures of (A) and (B).

Any of (A) to (C) above may be used as preferred alicyclic dicarboxylic acid ester compounds according to the invention, but (A) or (C) is particularly preferred from the standpoint of heat and hydrolytic stability.

In the case of (C), the proportion of (A) and (B) is not particularly restricted, but (A) is present at preferably 5% by mass or greater, more preferably 10% by mass or greater, even more preferably 15% by mass or greater and most preferably 20% by mass or greater, with respect to the total of (A) and (B) from the standpoint of heat and hydrolytic stability.

For the $R^1$ components of formula (1) for the preferred alicyclic dicarboxylic acid ester compound of the invention, the ratio (molar ratio) of $R^1$ derived from an alcohol of (a) component and $R^1$ derived from an alcohol of (b) component is not particularly restricted, but it is preferably in the range of 1/99 to 99/1 since this will allow the lubricity, heat and hydrolytic stability and refrigerant miscibility to all be satisfied.

From a standpoint focused on the miscibility, the ratio (molar ratio) of $R^1$ derived from an (a) alcohol and $R^1$ derived from a (b) alcohol is preferably in the range of 60/40 to 99/1, more preferably in the range of 70/30 to 99/1 and most preferably in the range of 80/20 to 99/1. From a standpoint more focused on the heat and hydrolytic stability and lubricity, the aforementioned ratio is preferably in the range of 1/99 to 60/40, more preferably in the range of 1/99 to 50/50 and most, preferably in the range of 1/99 to 40/60.

The alicyclic dicarboxylic acid ester compound may of course contain one or more than one hydrocarbon groups on the carbon atoms of the alicyclic ring. Alkyl groups are preferred as such hydrocarbon groups, with methyl group being particularly preferred from the standpoint of miscibility.

An alicyclic dicarboxylic acid ester compound according to the invention has the structure described above, and such ester compounds are prepared by esterification of the prescribed acid component and alcohol component by a common process, preferably in an inert gas atmosphere such as nitrogen and with heating in the presence of an esterifying catalyst or without a catalyst.

As acid components for the alicyclic dicarboxylic acid ester compound there may be mentioned cycloalkanedicarboxylic acids, cycloalkenedicarboxylic acids and their acid anhydrides, wherein two ester groups are bonded to mutually adjacent carbon atoms on the alicyclic ring, and any one or mixture of two or more of these may be used. Specifically there may be mentioned 1,2-cyclohexanedicarboxylic acid, 4-cyclohexene-1,2-dicarboxylic acid, 1-cyclohexene-1,2-dicarboxylic acid, 3-methyl-1,2-cyclohexanedicarboxylic acid, 4-methyl-1,2-cyclohexanedicarboxylic acid, 3-methyl-4-cyclohexene-1,2-dicarboxylic acid, 4-methyl-4-cyclohexene-1,2-dicarboxylic acid and their acid anhydrides. Of these, 1,2-cyclohexanedicarboxylic acid, 3-methyl-1,2,-cyclohexanedicarboxylic acid, 4-methyl-1,2-cyclohexanedicarboxylic acid and their acid anhydrides are preferred from the standpoint of minimizing rise in viscosity of the prepared ester compound during its use under prolonged and severe conditions, with 1,2-cyclohexanedicarboxylic acid being most preferred for its excellent miscibility. On the other hand, 4-cyclohexene-1,2-dicarboxylic acid, 1-cyclohexene-1,2-dicarboxylic acid, 4-methyl-1,2-cyclohexanedicarboxylic acid, 3-methyl-4-cyclohexene-1,2-dicarboxylic acid and 4-methyl-4-cyclohexene-1,2-dicarboxylic acid and their acid anhydrides are preferred from the standpoint of minimizing rise in the total acid value during use under prolonged and severe conditions, with 4-cyclohexene-1,2-dicarboxylic acid being most preferred for its excellent miscibility and heat and hydrolytic stability. According to the invention, when one of the aforementioned alicyclic dicarboxylic acids is used as the acid component, the molar ratio of cis-forms and trans-forms in the alicyclic dicarboxylic acid must be between 20/80 and 80/20, preferably between 25/75 and 75/25, and more preferably between 30/70 and 70/30.

There are no particular restrictions on the production process for these alicyclic dicarboxylic acids and their anhydrides, and any conventional publicly known process may be employed. As a specific example, 4-cyclohexene-1,2-dicarboxylic acid may be obtained by reacting butadiene and maleic anhydride in a benzene solvent at 100° C.

The alcohol component of the alicyclic dicarboxylic acid ester compound of the invention may be a straight chain alcohol of 3–18 carbons, a branched chain alcohol of 3–18 carbons or a cycloalcohol of 5–10 carbons. Specifically there may be mentioned straight or branched chain propanol (including n-propanol, 1-methylethanol, etc.), straight or branched chain butanol (including n-butanol, 1-methylpropanol, 2-methylpropanol, etc.), straight or branched chain pentanol (including n-pentanol, 1-methylbutanol, 2-methylbutanol, 3-methylbutanol, etc.), straight or branched chain hexanol (including n-hexanol, 1-methylpentanol, 2-methylpentanol, 3-methylpentanol, etc.), straight or branched chain heptanol (including n-heptanol, 1-methylhexanol, 2-methylhexanol, 3-methylhexanol, 4-methylhexanol, 5-methylhexanol, 2,4-dimethylpentanol, etc.), straight or branched chain octanol (including n-octanol, 2-ethylhexanol, 1-methylheptanol, 2-methylheptanol, etc.), straight or branched chain nonanol (including n-nonanol, 1-methyloctanol, 3,5,5-trimethylhexanol, 1-(2'-methylpropyl)-3-methylbutanol, etc.), straight or branched chain decanol (including n-decanol, iso-decanol, etc.), straight or branched chain undecanol (including n-undecanol, etc.), straight or branched chain dodecanol (including n-dodecanol, iso-dodecanol, etc.), straight or branched chain tridecanol, straight or branched chain tetradecanol (including n-tetradecanol, iso-tetradecanol, etc.), straight or branched chain pentadecanol, straight or branched chain hexadecanol (including n-hexadecanol, iso-hexadecanol, etc.), straight or branched chain heptadecanol, straight or branched chain octadecanol (including n-octadecanol, iso-octadecanol, etc.), cyclohexanol, methylcyclohexanol, dimethylcyclohexanol, and the like.

As mentioned above, a preferred alcohol component used according to the invention is (a) at least one type of alcohol selected from the group consisting of aliphatic alcohols of 1–5 carbons, and (b) at least one type of alcohol selected from the group consisting of aliphatic alcohols of 6–18 carbons.

As alcohols of (a) above there may be mentioned straight chain alcohols of 1–5 carbons and branched chain alcohols of 3–5 carbons. As specific examples there may be mentioned methanol, ethanol, n-propanol, n-butanol, n-pentanol, iso-propanol, iso-butanol, sec-butanol and iso-pentanol, among which n-butanol and n-pentanol are preferred from the standpoint of lubricity, while iso-butanol and iso-pentanol are preferred from the standpoint of heat and hydrolytic stability.

On the other hand, as alcohols of (b) above there may be mentioned straight chain alcohols of 6–18 carbons and branched chain alcohols of 6–18 carbons. As specific examples there may be mentioned n-hexanol, n-heptanol, n-octanol, n-nonanol, n-decanol, n-undecanol, n-dodecanol, n-tetradecanol, n-hexadecanol, n-octadecanol, iso-hexanol, 2-methylhexanol, 1-methylheptanol, 2-methylheptanol, iso-heptanol, 2-ethylhexanol, 2-octanol, iso-octanol, 3,5,5-trimethylhexanol, iso-decanol, iso-tetradecanol, iso-hexadecanol, iso-octadecanol and 2,6-dimethyl-4-heptanol, with n-heptanol, n-octanol, n-nonanol and n-decanol being preferred from the standpoint of both lubricity and miscibility, and iso-heptanol, 2-ethylhexanol and 3,5,5-trimethylhexanol being preferred from the standpoint of both miscibility and heat and hydrolytic stability.

When the aforementioned acid component and alcohol component are used for esterification reaction, the alcohol component is used at 1.0–1.5 equivalents and preferably 1.05–1.2 equivalents to 1 equivalent of the acid component, for example.

Furthermore, instead of the aforementioned acid components and alcohol components, lower alcohol esters of these acid components and/or acetic acid esters and propionic acid esters of these alcohols may be used to obtain alicyclic dicarboxylic acid ester compounds according to the invention by ester exchange reaction.

Specific examples of esterifying catalysts to be used for the invention include Lewis acids such as aluminum derivatives, tin derivatives and titanium derivatives; alkali metal salts such as sodium alkoxides and potassium alkoxides; and sulfonic acids such as para-toluenesulfonic acid, methanesulfonic acid and sulfuric acid. The amount of esterifying catalyst used may be, for example, about 0.1–1% by mass with respect to the total of the acid component and alcohol component raw materials. In consideration of the effect on the heat and hydrolytic stability of the obtained alicyclic dicarboxylic acid ester compound, a Lewis acid such as an aluminum derivative, tin derivative or titanium derivative is preferred, and tin derivatives are particularly preferred from the standpoint of reaction efficiency.

The temperature for the esterification is typically 150–230° C., and the reaction is usually complete by 3 to 30 hours.

After completion of the esterification reaction, the excess raw materials are distilled off under reduced pressure or under ordinary pressure, and then a common purification method such as liquid/liquid extraction, reduced pressure distillation, adsorption purification treatment with active carbon or the like, may be employed to purify the ester compound.

By using as the acid component of the raw material for the esterification reaction an alicyclic dicarboxylic acid with a molar ratio of 20/80 to 80/20 for cis-forms and trans-forms, it is possible to obtain an alicyclic dicarboxylic ester with a molar ratio of 20/80 to 80/20 for cis-forms and trans-forms. When an alicyclic dicarboxylic anhydride is used as the acid component of the raw material, the reaction may also be carried out under prescribed conditions to obtain an alicyclic dicarboxylic acid ester with the cis-form/trans-form molar ratio within the range specified above. An already prepared cis-form alicyclic dicarboxylic acid ester and trans-form alicyclic dicarboxylic acid ester may also be mixed with their molar ratios within the range specified above.

There are no particular restrictions on the content of the alicyclic dicarboxylic acid ester compound in the refrigerating machine oil composition of the invention, but it is preferably present at 5% by mass or greater, more preferably 10% by mass or greater, even more preferably 30% by mass or greater and most preferably 50% by mass or greater based on the total of the refrigerating machine oil composition, in order to bring out the excellent performance of the alicyclic dicarboxylic acid ester compound.

The alicyclic dicarboxylic acid ester compound in the refrigerating machine oil composition of the invention is used primarily as a base oil. While the alicyclic dicarboxylic acid ester compound may be used alone as the base oil for the refrigerating machine oil composition of the invention, it may also be used in combination with oxygen-containing synthetic oils including esters other than the alicyclic dicarboxylic acid ester compound specified by the invention, such as polyol esters and complex esters, polyglycols, polyvinyl ethers, ketones, polyphenyl ethers, silicones, polysiloxanes and perfluoroethers.

There are no particular restrictions on the amount of oxygen-containing synthetic oils included. From the standpoint of achieving improvement in thermal efficiency as well as heat and hydrolytic stability of the refrigerating machine oil, however, other oxygen-containing synthetic oils are preferably present at no greater than 150 parts by weight, and more preferably no greater than 100 parts by weight, to 100 parts by weight of the alicyclic dicarboxylic acid ester compound.

The refrigerating machine oil composition of the invention comprises an alicyclic dicarboxylic acid ester compound and if necessary oxygen-containing synthetic oils, and these are used primarily for the base oil. The refrigerating machine oil composition of the invention may also be suitably used with no further additives, or if necessary, it may be used in a form combined with various additives.

For further enhancement of the abrasion resistance and load resistance of the refrigerating machine oil composition of the invention, it may further include at least one type of phosphorus compound selected from the group consisting of phosphoric acid esters, acidic phosphoric acid esters, amine salts of acidic phosphoric acid ester, chlorinated phosphoric acid esters and phosphorous acid esters. These phosphorus compounds are esters of phosphoric acid or phosphorous acid with alkanols and polyether alcohols, or derivatives thereof.

As specific examples of phosphoric acid esters there may be mentioned tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate and xylenyldiphenyl phosphate. As acidic phosphoric acid esters there may be mentioned monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate and dioleyl acid phosphate. As amine salts of acidic phosphoric acid ester there may be mentioned amine salts of the above acidic phosphoric esters and amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine and trioctylamine. As chlorinated phosphoric acid esters there may be mentioned tris dichloropropyl phosphate, tris chloroethyl phosphate, tris chlorophenyl phosphate and polyoxyalkylene bis[di(chloroalkyl)] phosphate. As phosphorous acid esters there may be mentioned dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphate, triundecyl phosphite, tridodecyl phosphite, trioleyl phosphate, triphenyl phosphate and tricresyl phosphite. Mixtures of these may also be used.

When such phosphorus compounds are added to the refrigerating machine oil composition of the invention there are no particular restrictions on their content, but such phosphorus compounds will usually be added to a content of 0.01–5.0% by mass and preferably 0.02–3.0% by mass, based on the total of the refrigerating machine oil composition (based on the total of the base oil and all additives).

For enhanced heat and hydrolytic stability of the refrigerating machine oil composition of the invention, there may also be included one or more epoxy compounds selected from the group consisting of the following (i) to (viii):

(i) phenylglycidyl ether-type epoxy compounds (ii) alkylglycidyl ether-type epoxy compounds (iii) glycidyl ester-type epoxy compounds (iv) allyloxirane compounds (v) alkyloxirane compounds (vi) alicyclic epoxy compounds (vii) epoxidized fatty acid monoesters (viii) epoxidized vegetable oils Specific examples of (i) phenylglycidyl ether-type epoxy compounds include phenylglycidyl ethers and alkylphenylglycidyl ethers. Here, the alkylphenylglycicyl ethers may have 1–3 alkyl groups of 1–13 carbons, among which preferred examples include those with one alkyl group of 4–10 carbons, such as n-butylphenylglycidyl ether, i-butylphenylglycidyl ether, sec-butylphenylglycidyl ether, tert-butylphenylglycidyl ether, pentylphenylglycidyl ether, hexylphenylglycidyl ether, heptylphenylglycidyl ether, octylphenylglycidyl ether, nonylphenylglycidyl ether and decylphenylglycidyl ether.

Specific examples of (ii) alkylglycidyl ether-type epoxy compounds include decylglycidyl ether, undecylglycidyl ether, dodecylglycidyl ether, tridecylglycidyl ether, tetradecylglycidyl ether, 2-ethylhexylglycidyl ether, neopentylglycoldiglycidyl ether, trimethylolpropane triglycidyl ether, pentaerythritol tetraglycidyl ether, 1,6-hexanediol diglycidyl ether, sorbitolpolyglycidyl ether, polyalkyleneglycol monoglycidyl ether and polyalkyleneglycol diglycidyl ether.

Specific examples of (iii) glycidyl ester-type epoxy compounds include compounds represented by the following general formula (2):

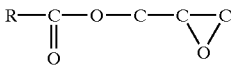

(2)

where R represents a hydrocarbon group of 1–18 carbons.

In formula (2) above, R represents a hydrocarbon group of 1–18 carbons, and as such hydrocarbon groups there may be mentioned alkyl groups of 1–18 carbons, alkenyl groups of 2–18 carbons, cycloalkyl groups of 5–7 carbons, alkylcycloalkyl groups of 6–18 carbons, aryl groups of 6–10 carbons, alkylaryl groups of 7–18 carbons and arylalkyl groups of 7–18 carbons. Preferred among these are alkyl groups of 5–15 carbons, alkenyl groups of 2–15 carbons, phenyl groups and alkylphenyl groups with alkyl groups of 1–4 carbons.

Specific preferred examples among these glycidyl ester epoxy compounds include glycidyl-2,2-dimethyl octanoate, glycidyl benzoate, glycidyl-tert-butyl benzoate, glycidyl acrylate, glycidyl methacrylate and the like.

Specific examples of (iv) allyloxirane compounds include 1,2-epoxystyrene and alkyl-1,2-epoxystyrene.

Specific examples of (v) alkyloxirane compounds include 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1,2-epoxyoctadecane, 2-epoxynonadecane and 1,2-epoxyeicosane.

As (vi) alicyclic epoxy compounds there may be mentioned compounds wherein carbon atoms composing the epoxy group are directly part of the alicycle, such as compounds represented by the following general formula (3):

(3)

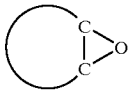

Specific examples of such alicyclic epoxy compounds include 1,2-epoxycyclohexane, 1,2-epoxycyclopentane, 3,4-epoxycyclohexylmethyl-3,4-epoxycyclohexane carboxylate, bis(3,4-epoxycyclohexylmethyl) adipate, exo-2,3-epoxynorbornane, bis(3,4-epoxy-6-methylcyclohexylmethyl) adipate, 2-(7-oxabicyclo[4.1.0]hept-3-yl)-spiro(1,3-dioxane-5,3'-[7]oxabicyclo[4.1.0]heptane, 4-(1'-methylepoxyethyl)-1,2-epoxy-2-methylcyclohexane, 4-epoxyethyl-1,2-epoxycyclohexane.

Specific examples of (vii) epoxidized fatty acid monoesters include esters of epoxidized fatty acids of 12–20 carbons and alcohols of 1–8 carbons, phenols or alkylphenols. Particularly preferred for use are butyl, hexyl, benzyl, cyclohexyl, methoxyethyl, octyl, phenyl and butylphenyl esters of epoxystearic acid.

Specific examples of (viii) epoxidized vegetable oils include epoxy compounds of vegetable oils such as soybean oil, linseed oil and cottonseed oil.

Among the aforementioned epoxy compounds, phenylglycidyl ether epoxy compounds, glycidyl ester epoxy compounds, alicyclic epoxy compounds and epoxidized fatty acid monoesters are preferred for further improved heat and hydrolytic stability, with glycidyl ester epoxy compounds and alicyclic epoxy compounds being even more preferred.

When these epoxy compounds are incorporated in a refrigerating machine oil composition according to the invention, there are no particular restrictions on their addition content but the epoxy compound is added to a content of preferably 0.1–5.0% by mass and more preferably 0.2–2.0% by mass, based on the total amount of the refrigerating machine oil composition (the total amount of the base oil and all incorporated additives).

Two or more different types of the aforementioned phosphorus compounds and epoxy compounds may, of course, be used in combination.

In order to further improve performance, the refrigerating machine oil composition of the invention may be incorporated, as required, with hitherto publicly known additives for refrigerating machine oils, for example, phenol-type antioxidants such as di-tert-butyl-p-cresol and bisphenol A; amine-type antioxidants such as phenyl-α-naphthylamine and N,N-di(2-naphthyl)-p-phenylenediamine; wear resistance agents such as zinc dithiophosphate; extreme pressure agents such as chlorinated paraffin and sulfur compounds; oiliness improvers such as fatty acids; antifoaming agents such as silicone types; metal inactivators such as benzotriazole; viscosity index improvers; pour-point depressants; detergent dispersants and the like, either alone or in combinations of more than one type. The total amount of the additives added into the refrigerating machine oil is not particularly limited, but in general the content is preferably not more than 10% by mass and more preferably not more than 5% by mass, of the total amount of the refrigerating machine oil composition (i.e., the total amount of the base oil and all incorporated additives).

The kinematic viscosity of the refrigerating machine oil of the invention is not particularly limited, but the kinematic viscosity at 40° C. is preferably within a range of 3 to 100 $mm^2/s$, more preferably 4 to 50 $mm^2/s$ and most preferably 5 to 40 $mm^2/s$. Further, the kinematic viscosity at 100° C. is within a range of 1 to 20 $mm^2/s$ and more preferably 2 to 10 $mm^2/s$. One of the effects achieved by the invention is that satisfactory heat and hydrolytic stability can be obtained even when the viscosity is low, and this effect is more notably achieved in the case where the kinematic viscosity at 40° C. is within a range of preferably 5 to 35 $mm^2/s$, more preferably 5 to 25 $mm^2/s$, even more preferably 5 to 20 $mm^2/s$, and most preferably 5 to 15 $mm^2/s$.

Also, the volume resistivity of the refrigerating machine oil composition of the invention is not particularly limited, but is preferably at least $1.0\times10^{11}$ Ω·cm, more preferably at least $1.0\times10^{12}$ Ω·cm and most preferably at least $1.0\times10^{13}$ Ω·cm. Particularly, when the refrigerating machine oil composition is used for a hermetic type refrigerating machine, a high electric insulating property tends to be requisite. According to the present invention, the volume resistivity is represented by the value [Ω·cm] at 25° C. measured in accordance with JIS C 2101 "Electric Insulating Oil Testing Method."

The moisture content of the refrigerating machine oil composition of the invention is not particularly limited, but is preferably no greater than 200 ppm, more preferably no greater than 100 ppm, and most preferably no greater than 50 ppm, of the total amount of the refrigerating machine oil composition. A low moisture content is particularly required when the refrigerating machine oil composition is used for a hermetic type refrigerating machine, because of its effects on the heat and hydrolytic stability and the electric insulating property of the oil.

The total acid value of the refrigerating machine oil composition of the invention is also not particularly limited, but when the oil composition is used in a refrigerating machine or in pipes to prevent metals from corrosion, the total acid value is preferably no greater than 0.1 mgKOH/g, and more preferably no greater than 0.05 mgKOH/g. According to the invention, the total acid value is represented as the total acid value measured in accordance with JIS K 2501 "Petroleum Products and Lubricating Oils—Neutralization Value Testing Method".

The ash content of the refrigerating machine oil composition of the invention is not particularly limited, but in order to improve the heat and hydrolytic stability of the oil and reduce generation of sludge and the like, it is preferably no greater than 100 ppm, and more preferably no greater than 50 ppm. According to the invention, the ash content is represented by the ash content value [ppm] as measured in accordance with JIS K 2272 "Testing Method for Ash Content and Sulfuric Acid Ash Content in Crude Oils and Petroleum Products".

Refrigerants that may be used in refrigerating machines that employ refrigerating machine oil compositions according to the invention include HFC refrigerants, fluorine-containing ether refrigerants such as perfluoroethers; fluorine-free ether refrigerants such as dimethyl ethers; and natural refrigerants such as carbon dioxide, hydrocarbons and the like, and these refrigerants can be used alone or in combinations including two or more kinds of the refrigerants.

As HFC refrigerants there may be mentioned hydrofluorocarbons having 1–3 and preferably 1 or 2 carbon atoms. Specific examples include HFCs such as difluoromethane (HFC-32), trifluoromethane (HFC-23), pentafluoroethane (HFC-125), 1,1,2,2-tetrafluoroethane (HFC-134), 1,1,1,2-tetrafluoroethane (HFC-134a), 1,1,1-trifluoroethane (HFC-143a), 1,1-difluoroethane (HFC-152a), and mixtures of two or more kinds of these HFCs. The refrigerant is selected in accordance with the intended use and the required performance, and as preferred examples there may be mentioned HFC-32 alone; HFC-23 alone; HFC-134a alone; HFC-125 alone; a mixture of HFC-134a/HFC-32=60–80% by mass/40–20% by mass; a mixture of HFC-32/HFC-125=40–70% by mass/60–30% by mass; a mixture of HFC-125/HFC-143a=40–60% by mass/60–40% by mass; a mixture of HFC-134a/HFC-32/HFC-125=60% by mass/30% by mass/10% by mass; a mixture of HFC-134a/HFC-32/HFC-125=40–70% by mass/15–35% by mass/5–40% by mass; and a mixture of HFC-125/HFC-134a/HFC-143a=35–55% by mass/1–15% by mass/40–60% by mass. More specific examples include a mixture of HFC-134a/HFC-32=70/30% by mass; a mixture of HFC-32/HFC-125=60/40% by mass; a mixture of HFC-32/HFC-125=50/50% by mass (R410A); a mixture of HFC-32/HFC-125=45/55% by mass (R410B); a mixture of HFC-125/HFC-143a=50/50% by mass (R507C); a mixture of HFC-32/HFC-125/HFC-134a=30/10/60% by mass; a mixture of HFC-32/HFC-125/HFC-134a=23/25/52% by mass (R407C); a mixture of HFC-32/HFC-125/HFC-134a=25/15/60% by mass (R407E); and a mixture of HFC-125/HFC-134a/HFC-143a=44/4/52% by mass (R404A).

Examples of natural refrigerants include carbon dioxide, hydrocarbons and the like. A hydrocarbon refrigerant referred to here is preferably a gas at 25° C. under 1 atm. Specifically such gases include alkanes, cycloalkanes and alkenes of 1 to 5 carbons and preferably 1 to 4 carbons, as well as mixtures thereof. Specific examples of such hydrocarbon refrigerants include methane, ethylene, ethane, propylene, propane, cyclopropane, butane, isobutane (i-butane), cyclobutane, methylcyclopropane and mixtures of two or more of these compounds. Propane, butane, isobutane and mixtures thereof are preferred among these.

The refrigerating machine oil composition of the invention normally exists in the form of a refrigerating machine fluid composition mixed with a refrigerant as describe above when it is used in the refrigerating machine. According to the fluid composition, the mixing ratio of the refrigerating machine oil composition to the refrigerant is not particularly limited, but the amount of the refrigerating machine oil composition is preferably within a range of 1 to 500 parts by weight and more preferably within a range of 2 to 400 parts by weight to 100 parts by weight of the refrigerant.

The refrigerating machine oil composition of the invention can be used as a lubricating oil for refrigerant compressors in all types of refrigerating machines, because of its excellent electric properties and low hygroscopicity. The refrigerating machines in which the composition may be used include, specifically, an air conditioner for rooms, a package air conditioner, a cold-storage chest (refrigerator), an automotive air conditioner, a dehumidifier, a freezer, a freeze and refrigeration warehouse, an automatic vending machine, a showcase, a cooling apparatuses in chemical plants, etc. The refrigerating machine oil composition of the invention is most preferably used in refrigerating machines equipped with hermetic compressors. The refrigerating machine oil composition of the invention may be used with all types of compressors including reciprocating types, rotary types and centrifugal types.

The construction of the preferred refrigerating cycle in which the composition of the invention is used will typically be equipped with a compressor, a condenser, an expander and an evaporator, and if necessary a drier.

The compressor may be; for example, a high-pressure container-system compressor wherein a motor comprising a rotator and a stator, a rotating shaft fitted in the rotator, and a compressor section connected to the motor are housed in a sealed container holding a refrigerating machine oil, and high-pressure refrigerant gas ejected from the compressor section is collected in the sealed container, or a low-pressure container-system compressor wherein a motor comprising a rotator and a stator, a rotating shaft fitted in the rotator, and a compressor section connected to the motor are housed in a sealed container holding a refrigerating machine oil, and high-pressure refrigerant gas ejected from the compressor section is directly ejected out of the sealed container.

An insulating film used as the electric insulating system material for the motor section may be a crystalline plastic film with a glass transition point of 50° C. or higher, specific preferred examples of which include one or more types of insulating films selected from the group consisting -of polyethylene terephthalate, polybutylene terephthalate, polyphenylene sulfide, polyether-ether-ketone, polyethylene naphthalate, polyamideimide and polyimide, or composite films prepared by laminating high glass transition point resin layers on low glass transition point films, because of their resistance to deterioration in tensile strength and electric insulating property. The magnet wire which is used for the motor section is preferably one with an enamel coating having a glass transition point of 120° C. or higher, such as a monolayer of a polyester, polyester imide, polyamide or polyamideimide, or an enamel coating which is a composite coating of a high glass transition point upper layer on a low glass transition point underlayer. As composite coated enamel wires there may be mentioned those with a polyamideimide upper layer coated on a polyester imide underlayer (AI/EI), and those with a polyamideimide upper layer coated on a polyester underlayer (AI/PE) The drying agent packed in the drier is preferably synthetic zeolite comprising an alkali metal silicate/aluminate compound salt with a carbon dioxide gas absorption volume of no greater than 1.0% at a pore size of 3.3 Angstroms or smaller and a carbon dioxide gas partial pressure of 250 mmHg at 25° C. Specific examples include the trade names XH-9, XH-10, XH-11 and XH-600 by Union Showa Co., Ltd.

EXAMPLES

The present invention will now be explained in further detail by way of examples and comparative examples, with the understanding that the invention is in no way limited thereby.

Examples 1–32 and Comparative Examples 1–32

Sample oils were prepared for Examples 1–32 and Comparative Examples 1–32, using each of the following base oils and additives. The contents (% by mass) of the additives in the examples (based on the total sample oil weight) and the properties of each of the obtained sample oils (kinematic viscosity at 40° C. and 100° C., total acid value) are shown in Tables 1–11.

[Base Oil]

Base Oil 1: Ester obtained from 1,2-cyclohexanedicarboxylic acid and i-heptanol (Ester 1: 100% by mass, cis-form/trans-form ratio (molar ratio)=55/45)

Base Oil 2: Ester obtained from 1,2-cyclohexanedicarboxylic acid and 2-ethylhexanol (Ester 2: 100% by mass, cis-form/trans-form ratio (molar ratio)=58/42)

Base Oil 3: Ester obtained from 1,2-cyclohexanedicarboxylic acid and 3,5,5-trimethylhexanol (Ester 3: 100% by mass, cis-form/trans-form ratio (molar ratio)=39/61)

Base Oil 4: Ester obtained from 1,2-cyclohexanedicarboxylic acid and i-nonanol (Ester 4: 100% by mass, cis-form/trans-form ratio (molar ratio)=66/34)

Base Oil 5: Ester obtained from 1,2-cyclohexanedicarboxylic acid and i-decanol (Ester 5: 100% by mass, cis-form/trans-form ratio (molar ratio)=49/51)

Base Oil 6: Ester obtained from 4-cyclohexene-1,2-dicarboxylic acid and i-heptanol (Ester 6: 100% by mass, cis-form/trans-form ratio (molar ratio)=35/65)

Base oil 7: Ester obtained from 4-cyclohexene-1,2-dicarboxylic acid and 2-ethylhexanol (Ester 7: 100% by mass, cis-form/trans-form ratio (molar ratio)=45/55)

Base Oil 8: Ester obtained from 4-cyclohexene-1,2-dicarboxylic acid and 3,5,5-trimethylhexanol (Ester 8: 100% by mass, cis-form/trans-form ratio (molar ratio)=67/33)

Base Oil 9: Ester obtained from 1,2-cyclohexanedicarboxylic acid, i-butanol and n-heptanol (Ester 9: 24% by mass, ester 10: 1% by mass, ester 11: 73% by mass, cis-form/trans-form ratio (molar ratio)=53/47)

Base Oil 10: Ester obtained from 1,2-cyclohexanedicarboxylic acid, i-butanol and 2-ethylhexanol (Ester 2: 51% by mass, ester 9: 36% by mass, ester 12; 13% by mass, cis-form/trans-form ratio (molar ratio)=37/63)

Base Oil 11: Ester obtained from 1,2-cyclohexanedicarboxylic acid, i-butanol and 3,5,5-trimethylhexanol (Ester 3: 27% by mass, ester 9: 18% by mass, ester 13: 55% by mass, cis-form/trans-form ratio (molar ratio)=62/38)

Base Oil 12: Ester obtained from 1,2-cyclohexanedicarboxylic acid, n-butanol and i-decanol (Ester 5: 36% by mass, ester 14: 19% by mass, ester 15: 45% by mass, cis-form/trans-form ratio (molar ratio)=46/56)

Base Oil 13: Ester obtained from 4-cyclohexene-1,2-dicarboxylic acid, i-butanol and n-heptanol (Ester 16: 25% by mass, ester 17: 2% by mass, ester 18: 73% by mass, cis-form/trans-form ratio (molar ratio)=56/44)

Base Oil 14: Ester obtained from 4-cyclohexene-1,2-dicarboxylic acid, i-butanol and 2-ethylhexanol (Ester 7: 51% by mass, ester 16: 39% by mass, ester 19: 10% by mass, cis-form/trans-form ratio (molar ratio)=37/63)

Base Oil 15: Ester obtained from 4-cyclohexene-1,2-dicarboxylic acid, i-butanol and 3,5,5-trimethylhexanol (Ester 8: 26% by mass, ester 16: 17% by mass, ester 20: 57% by mass, cis-form/trans-form ratio (molar ratio)=42/58)

Base Oil 16: Ester obtained from 4-cyclohexene-1,2-dicarboxylic acid, n-butanol and i-decanol (Ester 21: 22% by mass, ester 22: 46% by mass, ester 23: 32% by mass, cis-form/trans-form ratio (molar ratio)=40/60)

Base Oil 17: Ester obtained from 1,2-cyclohexanedicarboxylic acid and i-heptanol (Ester 1: 100% by mass, cis-form/trans-form ratio (molar ratio)=90/10)

Base Oil 18: Ester obtained from 1,2-cyclohexanedicarboxylic acid and i-heptanol (Ester 1: 100% by mass, cis-form/trans-form ratio (molar ratio)=10/90)

Base Oil 19: Ester obtained from 1,2-cyclohexanedicarboxylic acid and 2-ethylhexanol (Ester 2: 100% by mass, cis-form/trans-form ratio (molar ratio)=90/10)

Base Oil 20: Ester obtained from 1,2-cyclohexanedicarboxylic acid and 2-ethylhexanol (Ester 2: 100% by mass, cis-form/trans-form ratio (molar ratio)=10/90)

Base Oil 21: Ester obtained from 1,2-cyclohexanedicarboxylic acid and 3,5,5-trimethylhexanol (Ester 3: 100% by mass, cis-form/trans-form ratio (molar ratio)=90/10)

Base Oil 22: Ester obtained from 1,2-cyclohexanedicarboxylic acid and 3,5,5-trimethylhexanol (Ester 3: 100% by mass, cis-form/trans-form ratio (molar ratio)=10/90)

Base Oil 23: Ester obtained from 1,2-cyclohexanedicarboxylic acid and i-nonanol (Ester 4: 100% by mass, cis-form/trans-form ratio (molar ratio)=90/10)

Base Oil 24: Ester obtained from 1,2-cyclohexanedicarboxylic acid and i-nonanol (Ester 4: 100% by mass, cis-form/trans-form ratio (molar ratio)=10/90)

Base Oil 25: Ester obtained from 1,2-cyclohexanedicarboxylic acid and i-decanol (Ester 5: 100% by mass, cis-form/trans-form ratio (molar ratio)=90/10)

Base Oil 26: Ester obtained from 1,2-cyclohexanedicarboxylic acid and i-decanol (Ester 5: 100% by mass, cis-form/trans-form ratio (molar ratio)=10/90)

Base Oil 27: Ester obtained from 4-cyclohexene-1,2-dicarboxylic acid and i-heptanol (Ester 6: 100% by mass, cis-form/trans-form ratio (molar ratio)=90/10)

Base Oil 28: Ester obtained from 4-cyclohexene-1,2-dicarboxylic acid and i-heptanol (Ester 6: 100% by mass, cis-form/trans-form ratio (molar ratio)=10/90)

Base Oil 29: Ester obtained from 4-cyclohexene-1,2-dicarboxylic acid and 2-ethylhexanol (Ester 7: 100% by mass, cis-form/trans-form ratio (molar ratio)=90/10)

Base Oil 30: Ester obtained from 4-cyclohexene-1,2-dicarboxylic acid and 2-ethylhexanol (Ester 7: 100% by mass, cis-form/trans-form ratio (molar ratio)=10/90)

Base Oil 31: Ester obtained from 4-cyclohexene-1,2-dicarboxylic acid and 3,5,5-trimethylhexanol (Ester 8: 100% by mass, cis-form/trans-form ratio (molar ratio)=90/10)

Base Oil 32: Ester obtained from 4-cyclohexene-1,2-dicarboxylic acid and 3,5,5-trimethylhexanol (Ester 8: 100% by mass, cis-form/trans-form ratio (molar ratio)=10/90)

Base Oil 33: Ester obtained from 1,2-cyclohexanedicarboxylic acid, i-butanol and n-heptanol (Ester 9: 25% by mass, ester 10: 2% by mass, ester 11: 73% by mass, cis-form/trans-form ratio (molar ratio)=90/10)

Base Oil 34: Ester obtained from 1,2-cyclohexanedicarboxylic acid, i-butanol and n-heptanol (Ester 9: 24% by mass, ester 10: 2% by mass, ester 11: 72% by mass, cis-form/trans-form ratio (molar ratio)=10/90)

Base Oil 35: Ester obtained from 1,2-cyclohexanedicarboxylic acid, i-butanol and 2-ethylhexanol (Ester 2: 50% by mass, ester 9: 38% by mass, ester 12: 12% by mass, cis-form/trans-form ratio (molar ratio)=90/10)

Base Oil 36: Ester obtained from 1,2-cyclohexanedicarboxylic acid, i-butanol and 2-ethylhexanol (Ester 2: 51% by mass, ester 9: 38% by mass, ester 12: 11% by mass, cis-form/trans-form ratio (molar ratio)=10/90)

Base Oil 37: Ester obtained from 1,2-cyclohexanedicarboxylic acid, i-butanol and 3,5,5-trimethylhexanol (Ester 3: 26% by mass, ester 9: 18% by mass, ester 13: 56% by mass, cis-form/trans-form ratio (molar ratio)=90/10)

Base Oil 38: Ester obtained from 1,2-cyclohexanedicarboxylic acid, i-butanol and 3,5,5-trimethylhexanol (Ester 3: 27% by mass, ester 9: 16% by mass, ester 13: 57% by mass, cis-form/trans-form ratio (molar ratio)=10/90)

Base Oil 39: Ester obtained from 1,2-cyclohexanedicarboxylic acid, n-butanol and i-decanol (Ester 5: 33% by mass, ester 14: 20% by mass, ester 15: 47% by mass, cis-form/trans-form ratio (molar ratio)=90/10)

Base Oil 40: Ester obtained from 1,2-cyclohexanedicarboxylic acid, n-butanol and i-decanol (Ester 5; 34% by mass, ester 14: 20% by mass, ester 15: 46% by mass, cis-form/trans-form ratio (molar ratio)=10/90)

Base Oil 41: Ester obtained from 4-cyclohexene-1,2-dicarboxylic acid, i-butanol and n-heptanol (Ester 16: 26% by mass, ester 17: 2% by mass, ester 18: 72% by mass, cis-form/trans-form ratio (molar ratio)=90/10)

Base Oil 42: Ester obtained from 4-cyclohexene-1,2-dicarboxylic acid, i-butanol and n-heptanol (Ester 16: 27% by mass, ester 17: 2% by mass, ester 18: 71% by mass, cis-form/trans-form ratio (molar ratio)=10/90)

Base Oil 43: Ester obtained from 4-cyclohexene-1,2-dicarboxylic acid, i-butanol and 2-ethylhexanol (Ester 7: 52% by mass, ester 16: 40% by mass, ester 19: 8% by mass, cis-form/trans-form ratio (molar ratio)=90/10)

Base Oil 44: Ester obtained from 4-cyclohexene-1,2-dicarboxylic acid, i-butanol and 2-ethylhexanol (Ester 7: 50% by mass, ester 16: 41% by mass, ester 19: 9% by mass, cis-form/trans-form ratio (molar ratio)=10/90)

Base Oil 45: Ester obtained from 4-cyclohexene-1,2-dicarboxylic acid, i-butanol and 3,5,5-trimethylhexanol (Ester 8: 26% by mass, ester 16: 18% by mass, ester 20: 56% by mass, cis-form/trans-form ratio (molar ratio)=90/10)

Base Oil 46: Ester obtained from 4-cyclohexene-1,2-dicarboxylic acid, i-butanol and 3,5,5-trimethylhexanol (Ester 8: 27% by mass, ester 16: 17% by mass, ester 20: 56% by mass, cis-form/trans-form ratio (molar ratio)=10/90)

Base Oil 47: Ester obtained from 4-cyclohexene-1,2-dicarboxylic acid, n-butanol and i-decanol (Ester 21: 20% by mass, ester 22: 47% by mass, ester 23: 33% by mass, cis-form/trans-form ratio (molar ratio)=90/10)

Base Oil 48: Ester obtained from 4-cyclohexene-1,2-dicarboxylic acid, n-butanol and i-decanol (Ester 21: 21% by mass, ester 22: 46% by mass, ester 23: 33% by mass, cis-form/trans-form ratio (molar ratio)=10/90).

[1,2-cyclohexanedicarboxylic acid esters 1–5, 9–15]

The 1,2-cyclohexanedicarboxylic acid esters of the above base oils 1–5, 9–12, 17–26 and 33–40 have a structure represented by the following general formula (4):

(4)

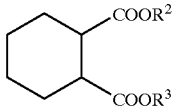

where $R^2$ and $R^3$ of each ester are the following.

Ester 1 $R^2$: i-heptyl group, $R^3$: i-heptyl group

Ester 2 $R^2$: 2-ethylhexyl group, $R^3$: 2-ethylhexyl group

Ester 3 $R^2$: 3,5,5-trimethylhexyl group, $R^3$: 3,5,5-trimethylhexyl group

Ester 4 $R^2$: i-nonyl group, $R^3$: i-nonyl group

Ester 5 $R^2$: i-decyl group, $R^3$: i-decyl group

Ester 9 $R^2$: i-butyl group, $R^3$: i-butyl group

Ester 10 $R^2$: i-butyl group, $R^3$: n-heptyl group

Ester 11 $R^2$: n-heptyl group, $R^3$: n-heptyl group

Ester 12 $R^2$: i-butyl group, $R^3$: 2-ethylhexyl group

Ester 13 $R^2$: i-butyl group, $R^3$: 3,5,5-trimethylhexyl group

Ester 14 $R^2$: n-butyl group, $R^3$: n-butyl group

Ester 15 $R^2$: n-butyl group, $R^3$: i-decyl group.

[4-cyclohexene-1,2-dicarboxylic acid esters 6–8, 16–23]

The 4-cyclohexene-1,2-dicarboxylic acid esters of the above base oils 6–8, 13–16, 27–32 and 41–48 have a structure represented by the following general formula (5):

(5)

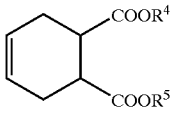

where $R^4$ and $R^5$ of each ester are the following.

Ester 6 $R^4$: i-heptyl group, $R^5$: i-heptyl group

Ester 7 $R^4$: 2-ethylhexyl group, $R^5$: 2-ethylhexyl group

Ester 8 $R^4$: 3,5,5-trimethylhexyl group, $R^5$: 3,5,5-trimethylhexyl group

Ester 16 $R^4$: i-butyl group, $R^5$: i-butyl group

Ester 17 $R^4$: i-butyl group, $R^5$: n-heptyl group

Ester 18 $R^4$: n-heptyl group, $R^5$: n-heptyl group

Ester 19 $R^4$: i-butyl group, $R^5$: 2-ethylhexyl group

Ester 20 $R^4$: i-butyl group, $R^5$: 3,5,5-trimethylhexyl group

Ester 21 $R^4$: n-butyl group, $R^5$: n-butyl group

Ester 22 $R^4$: n-butyl group, $R^5$: i-decyl group

Ester 23 $R^4$: i-decyl group, $R^5$: i-decyl group

[Additives]

Additive 1: Phenylglycidyl ether

Additive 2: Glycidyl-2,2-dimethyloctanoate

Additive 3: Cyclohexene Oxide

The following tests were then carried out for each of the sample oils of Examples 1–32 and Comparative Examples 1–32.

(Refrigerant Miscibility Test)

In accordance with the "Refrigerant Miscibility Testing Method" of JIS-K-2211 "Refrigerating machine oils", 1 g of each of the sample oils was blended with 29 g of HFC134a refrigerant to observe whether the sample oils and the refrigerant were miscible with each other at 0° C., or whether they separated or formed a turbid state. The results are shown in Tables 1 to 11.

(Electric Insulating Property Test)

The volume resistivity of each of the sample oils at 25° C. was measured in accordance with JIS-C-2101 "Electric Insulating Oil Testing Method." The results are shown in Tables 1 to 11.

(Heat/Hydrolytic Stability Test I)

A 90 g portion of each of the sample oils prepared with a moisture content of 1000 ppm by mass was weighed out into an autoclave which was sealed after addition of 10 g of HFC134a refrigerant and catalysts (iron, copper and aluminum wires). The autoclave was then heated at 200° C. for 2 weeks, after which the appearance of each of the sample oils and the catalysts was observed, and the volume resistivity and total acid value of each of the sample oils was measured. The results are shown in Tables 1 to 11.

(Lubricity Test)

A wear tester employing a vane (SKH-51) as the upper test specimen and a disk (FC250 HRC40) as the lower test specimen was mounted inside a sealed container. A 600 ml portion of the sample oil was introduced into the wear testing zone, and after evacuating the air from the system, HFC134a refrigerant was introduced and the system was heated. After adjustment of the system temperature to 100° C. and the refrigerant pressure to 1.5 MPa, a stepwise load was applied up to 100 kgf at a load step of 10 kgf (2 minute steps). After a 60 minute test for each sample oil, the wear width of the vane and the wear depth of the disk were measured. The results are shown in Tables 1 to 8.

(Heat/Hydrolytic Stability Test II)

A 90 g portion of each of the sample oils prepared with a moisture content of 1000 ppm by mass was weighed out into an autoclave which was sealed after addition of 10 g of HFC134a refrigerant and catalysts (iron, copper and aluminum wires). The autoclave was then heated at 200° C. for 2000 hours, after which the appearance of each of the sample oils and the catalysts was observed, and the volume resistivity and total acid value of each of the sample oils was measured. The results are shown in Tables 9 to 11.

TABLE 1

| | Example 1 | Example 2 | Example 3 | Example 4 | Example 5 | Example 6 |
|---|---|---|---|---|---|---|
| Base oil | Base oil 1 | Base oil 2 | Base oil 3 | Base oil 4 | Base oil 5 | Base oil 6 |
| Additive | | | | | | |
| Type | — | — | — | — | — | — |
| Content (% by mass) | — | — | — | — | — | — |
| Kinematic viscosity ($mm^2/s$) | | | | | | |
| 40° C. | 12.3 | 18.2 | 28.5 | 25.6 | 29.5 | 12.7 |
| 100° C. | 2.8 | 3.5 | 4.7 | 4.5 | 4.7 | 2.8 |
| Total acid value (mgKOH/g) | 0.01 | 0.01 | 0.01 | 0.01 | 0.01 | 0.01 |
| Miscibility | miscible | miscible | miscible | miscible | miscible | miscible |
| Volume resistivity (Ω · cm) | $3.3 \times 10^{13}$ | $4.9 \times 10^{13}$ | $8.1 \times 10^{13}$ | $7.9 \times 10^{13}$ | $9.2 \times 10^{12}$ | $3.5 \times 10^{12}$ |
| Heat/ hydrolytic stability I | | | | | | |
| Appearance of sample oil | no change | no change | no change | no change | no change | no change |
| Appearance of catalyst | | | | | | |
| Cu | no change | no change | no change | no change | no change | no change |
| Fe | no change | no change | no change | no change | no change | no change |
| Al | no change | no change | no change | no change | no change | no change |
| Volume resistivity (Ω · cm) | $4.9 \times 10^{12}$ | $6.3 \times 10^{12}$ | $1.9 \times 10^{13}$ | $3.5 \times 10^{13}$ | $4.4 \times 10^{12}$ | $1.7 \times 10^{11}$ |
| Total acid value (mgKOH/g) | 0.60 | 0.65 | 0.55 | 0.49 | 0.61 | 0.48 |

TABLE 1-continued

| | Example 1 | Example 2 | Example 3 | Example 4 | Example 5 | Example 6 |
|---|---|---|---|---|---|---|
| Lubricity test | | | | | | |
| Wear width (μm) | 335 | 330 | 320 | 315 | 340 | 295 |
| Wear depth (μm) | 1.3 | 1.4 | 1.1 | 1.5 | 1.4 | 1.1 |

TABLE 2

| | Example 7 | Example 8 | Example 9 | Example 10 | Example 11 | Example 12 |
|---|---|---|---|---|---|---|
| Base oil | Base oil 7 13 | Base oil 8 14 | Base oil 9 15 | Base oil 10 16 | Base oil 11 | Base oil 12 |
| Additive | | | | | | |
| Type | — | — | — | — | — | — |
| Content (% by mass) | — | — | — | — | — | — |
| Kinematic viscosity ($mm^2/s$) | | | | | | |
| 40° C. | 16.5 | 29.5 | 10.8 | 12.7 | 12.7 | 12.6 |
| 100° C. | 3.3 | 4.7 | 2.6 | 2.7 | 2.7 | 2.8 |
| Total acid value (mgKOH/g) | 0.01 | 0.01 | 0.00 | 0.00 | 0.00 | 0.00 |
| Miscibility | miscible | miscible | miscible | miscible | miscible | miscible |
| Volume resistivity (Ω · cm) | $2.2 \times 10^{13}$ | $3.2 \times 10^{13}$ | $7.5 \times 10^{12}$ | $3.2 \times 10^{13}$ | $3.7 \times 10^{13}$ | $3.6 \times 10^{13}$ |
| Heat/hydrolytic stability I | | | | | | |
| Appearance of sample oil | no change | no change | no change | no change | no change | no change |
| Appearance of catalyst | | | | | | |
| Cu | no change | no change | no change | no change | no change | no change |
| Fe | no change | no change | no change | no change | no change | no change |
| Al | no change | no change | no change | no change | no change | no change |
| Volume resistivity (Ω · cm) | $4.7 \times 10^{12}$ | $9.3 \times 10^{11}$ | $1.3 \times 10^{12}$ | $5.2 \times 10^{12}$ | $3.6 \times 10^{12}$ | $5.8 \times 10^{12}$ |
| Total acid value (mgKOH/g) | 0.52 | 0.63 | 0.79 | 0.31 | 0.41 | 0.48 |
| Lubricity test | | | | | | |
| Wear width (μm) | 300 | 270 | 250 | 295 | 285 | 320 |
| Wear depth (μm) | 1.2 | 1 | 0.8 | 1.1 | 1.2 | 1.2 |

TABLE 3

| | Example 13 | Example 14 | Example 15 | Example 16 | Comp. Example 1 | Comp. Example 2 |
|---|---|---|---|---|---|---|
| Base oil | Base oil 13 | Base oil 14 | Base oil 15 | Base oil 16 | Base oil 17 | Base oil 18 |
| Additive | | | | | | |
| Type | — | — | — | — | — | — |
| Content (% by mass) | — | — | — | — | — | — |
| Kinematic viscosity ($mm^2/s$) | | | | | | |
| 40° C. | 10.3 | 12.9 | 15.2 | 11.7 | 12.5 | 12.0 |
| 100° C. | 2.5 | 2.7 | 3.0 | 2.6 | 2.9 | 2.7 |
| Total acid value (mgKOH/g) | 0.00 | 0.00 | 0.00 | 0.00 | 0.01 | 0.00 |
| Miscibility | miscible | miscible | miscible | miscible | miscible | miscible |
| Volume resistivity ($\Omega \cdot cm$) | $1.9 \times 10^{12}$ | $1.2 \times 10^{12}$ | $1.9 \times 10^{13}$ | $2.6 \times 10^{13}$ | $2.7 \times 10^{13}$ | $1.5 \times 10^{13}$ |
| Heat/hydrolytic stability I | | | | | | |
| Appearance of sample oil | no change | no change | no change | no change | no change | no change |
| Appearance of catalyst | | | | | | |
| Cu | no change | no change | no change | no change | no change | no change |
| Fe | no change | no change | no change | no change | no change | partially blackened |
| Al | no change | no change | no change | no change | no change | no change |
| Volume resistivity ($\Omega \cdot cm$) | $5.6 \times 10^{11}$ | $3.4 \times 10^{11}$ | $2.3 \times 10^{12}$ | $4.5 \times 10^{12}$ | $5.4 \times 10^{12}$ | $1.0 \times 10^{10}$ |
| Total acid value (mgKOH/g) | 0.86 | 0.35 | 0.39 | 0.61 | 0.60 | 0.86 |
| Lubricity test | | | | | | |
| Wear width ($\mu m$) | 275 | 295 | 305 | 290 | 390 | 340 |
| Wear depth ($\mu m$) | 1.0 | 0.9 | 1.2 | 0.9 | 2.6 | 1.3 |

TABLE 4

| | Comp. Example 3 | Comp. Example 4 | Comp. Example 5 | Comp. Example 6 | Comp. Example 7 | Comp. Example 8 |
|---|---|---|---|---|---|---|
| Base oil | Base oil 19 | Base oil 20 | Base oil 21 | Base oil 22 | Base oil 23 | Base oil 24 |
| Additive | | | | | | |
| Type | — | — | — | — | — | — |
| Content (% by mass) | — | — | — | — | — | — |
| Kinematic viscosity ($mm^2/s$) | | | | | | |
| 40° C. | 18.2 | 18.2 | 28.5 | 28.5 | 25.6 | 25.6 |
| 100° C. | 3.5 | 3.5 | 4.7 | 4.7 | 4.5 | 4.5 |
| Total acid value (mgKOH/g) | 0.01 | 0.01 | 0.01 | 0.01 | 0.01 | 0.01 |
| Miscibility | miscible | miscible | miscible | miscible | miscible | miscible |
| Volume resistivity | $4.6 \times 10^{13}$ | $4.6 \times 10^{13}$ | $7.4 \times 10^{13}$ | $7.4 \times 10^{13}$ | $8.1 \times 10^{13}$ | $8.1 \times 10^{13}$ |

TABLE 4-continued

| | Comp. Example 3 | Comp. Example 4 | Comp. Example 5 | Comp. Example 6 | Comp. Example 7 | Comp. Example 8 |
|---|---|---|---|---|---|---|
| (Ω · cm) | | | | | | |
| Heat/ hydrolytic stability I | | | | | | |
| Appearance of sample oil | no change | no change | no change | no change | no change | no change |
| Appearance of catalyst | | | | | | |
| Cu | no change | no change | no change | no change | no change | no change |
| Fe | no change | partially blackened | no change | partially blackened | no change | partially blackened |
| Al | no change | no change | no change | no change | no change | no change |
| Volume resistivity (Ω · cm) | $6.3 \times 10^{12}$ | $2.1 \times 10^{11}$ | $2.2 \times 10^{12}$ | $9.8 \times 10^{10}$ | $2.8 \times 10^{13}$ | $2.5 \times 10^{11}$ |
| Total acid value (mgKOH/g) | 0.74 | 0.91 | 0.52 | 0.89 | 0.56 | 0.79 |
| Lubricity test | | | | | | |
| Wear width (μm) | 400 | 340 | 395 | 330 | 385 | 310 |
| Wear depth (μm) | 2.9 | 1.5 | 2.5 | 1.0 | 2.4 | 1.5 |

TABLE 5

| | Comp. Example 9 | Comp. Example 10 | Comp. Example 11 | Comp. Example 12 | Comp. Example 13 | Comp. Example 14 |
|---|---|---|---|---|---|---|
| Base oil | Base oil 25 | Base oil 26 | Base oil 27 | Base oil 28 | Base oil 29 | Base oil 30 |
| Additive | | | | | | |
| Type | — | — | — | — | — | — |
| Content (% by mass) | — | — | — | — | — | — |
| Kinematic viscosity ($mm^2/s$) | | | | | | |
| 40° C. | 29.5 | 29.5 | 12.8 | 12.5 | 18.9 | 17.7 |
| 100° C. | 4.7 | 4.7 | 2.8 | 2.8 | 3.6 | 3.4 |
| Total acid value (mgKOH/g) | 0.01 | 0.01 | 0.01 | 0.01 | 0.01 | 0.01 |
| Miscibility | miscible | miscible | miscible | miscible | miscible | miscible |
| Volume resistivity (Ω · cm) | $8.3 \times 10^{12}$ | $8.3 \times 10^{12}$ | $3.1 \times 10^{12}$ | $3.1 \times 10^{12}$ | $6.1 \times 10^{12}$ | $6.1 \times 10^{12}$ |
| Heat/ hydrolytic stability I | | | | | | |
| Appearance of sample oil | no change | no change | no change | no change | no change | no change |
| Appearance of catalyst | | | | | | |
| Cu | no change | no change | no change | no change | no change | no change |
| Fe | no change | partially blackened | no change | partially blackened | no change | partially blackened |
| Al | no change | no change | no change | no change | no change | no change |
| Volume resistivity | $3.1 \times 10^{12}$ | $7.9 \times 10^{10}$ | $1.1 \times 10^{11}$ | $1.0 \times 10^{10}$ | $4.6 \times 10^{11}$ | $1.5 \times 10^{10}$ |

TABLE 5-continued

| | Comp. Example 9 | Comp. Example 10 | Comp. Example 11 | Comp. Example 12 | Comp. Example 13 | Comp. Example 14 |
|---|---|---|---|---|---|---|
| (Ω · cm) | | | | | | |
| Total acid value (mgKOH/g) | 0.63 | 0.86 | 0.51 | 0.78 | 0.55 | 0.79 |
| Lubricity test | | | | | | |
| Wear width (μm) | 390 | 350 | 380 | 300 | 410 | 290 |
| Wear depth (μm) | 2.6 | 1.4 | 2.2 | 1.2 | 2.5 | 1.1 |

TABLE 6

| | Comp. Example 15 | Comp. Example 16 | Comp. Example 17 | Comp. Example 18 | Comp. Example 19 | Comp. Example 20 |
|---|---|---|---|---|---|---|
| Base oil | Base oil 31 | Base oil 32 | Base oil 33 | Base oil 34 | Base oil 35 | Base oil 36 |
| Additive | | | | | | |
| Type | — | — | — | — | — | — |
| Content (% by mass) | — | — | — | — | — | — |
| Kinematic viscosity ($mm^2/s$) | | | | | | |
| 40° C. | 29.5 | 29.3 | 10.9 | 10.8 | 12.7 | 12.8 |
| 100° C. | 4.7 | 4.7 | 2.6 | 2.6 | 2.7 | 2.7 |
| Total acid value (mgKOH/g) | 0.01 | 0.01 | 0.00 | 0.00 | 0.00 | 0.00 |
| Miscibility | miscible | miscible | miscible | miscible | miscible | miscible |
| Volume resistivity (Ω · cm) | $6.3 \times 10^{12}$ | $6.3 \times 10^{13}$ | $7.0 \times 10^{12}$ | $7.8 \times 10^{12}$ | $2.9 \times 10^{13}$ | $3.5 \times 10^{13}$ |
| Heat/hydrolytic stability I | | | | | | |
| Appearance of sample oil | no change | no change | no change | no change | no change | no change |
| Appearance of catalyst | | | | | | |
| Cu | no change | no change | no change | no change | no change | no change |
| Fe | no change | partially blackened | no change | partially blackened | no change | partially blackened |
| Al | no change | no change | no change | no change | no change | no change |
| Volume resistivity (Ω · cm) | $3.8 \times 10^{11}$ | $7.5 \times 10^{10}$ | $1.1 \times 10^{12}$ | $1.6 \times 10^{10}$ | $4.9 \times 10^{12}$ | $8.7 \times 10^{10}$ |
| Total acid value (mgKOH/g) | 0.64 | 0.85 | 0.81 | 1.12 | 0.29 | 0.87 |
| Lubricity test | | | | | | |
| Wear width (μm) | 375 | 260 | 365 | 265 | 390 | 285 |
| Wear depth (μm) | 2.1 | 0.8 | 1.9 | 0.9 | 2.3 | 1.0 |

TABLE 7

| | Comp. Example 21 | Comp. Example 22 | Comp. Example 23 | Comp. Example 24 | Comp. Example 25 | Comp. Example 26 |
|---|---|---|---|---|---|---|
| Base oil | Base oil 37 | Base oil 38 | Base oil 39 | Base oil 40 | Base oil 41 | Base oil 42 |
| Additive | | | | | | |
| Type | — | — | — | — | — | — |
| Content (% by mass) | — | — | — | — | — | — |
| Kinematic viscosity ($mm^2/s$) | | | | | | |
| 40° C. | 12.6 | 12.6 | 12.5 | 12.5 | 10.3 | 10.2 |
| 100° C. | 2.7 | 2.7 | 2.8 | 2.8 | 2.5 | 2.5 |
| Total acid value (mgKOH/g) | 0.00 | 0.00 | 0.00 | 0.00 | 0.00 | 0.00 |
| Miscibility | miscible | miscible | miscible | miscible | miscible | miscible |
| Volume resistivity ($\Omega \cdot cm$) | $2.8 \times 10^{13}$ | $3.9 \times 10^{13}$ | $3.5 \times 10^{13}$ | $3.7 \times 10^{13}$ | $1.0 \times 10^{12}$ | $2.1 \times 10^{12}$ |
| Heat/ hydrolytic stability I | | | | | | |
| Appearance of sample oil | no change | no change | no change | no change | no change | no change |
| Appearance of catalyst | | | | | | |
| Cu | no change | no change | no change | no change | no change | no change |
| Fe | no change | partialy blackened | no change | partially blackened | no change | partially blackened |
| Al | no change | no change | no change | no change | no change | no change |
| Volume resistivity ($\Omega \cdot cm$) | $4.5 \times 10^{12}$ | $1.1 \times 10^{11}$ | $6.7 \times 10^{12}$ | $8.4 \times 10^{10}$ | $5.5 \times 10^{11}$ | $9.4 \times 10^{9}$ |
| Total acid value (mgKOH/g) | 0.39 | 0.76 | 0.53 | 0.93 | 0.90 | 1.35 |
| Lubricity test | | | | | | |
| Wear width ($\mu m$) | 405 | 290 | 410 | 310 | 370 | 280 |
| Wear depth ($\mu m$) | 2.7 | 1.1 | 2.5 | 1.1 | 2.1 | 0.9 |

TABLE 8

| | Comp. Example 27 | Comp. Example 28 | Comp. Example 29 | Comp. Example 30 | Comp. Example 31 | Comp. Example 32 |
|---|---|---|---|---|---|---|
| Base oil | Base oil 43 | Base oil 44 | Base oil 45 | Base oil 46 | Base oil 47 | Base oil 48 |
| Additive | | | | | | |
| Type | — | — | — | — | — | — |
| Content (% by mass) | — | — | — | — | — | — |
| Kinematic viscosity ($mm^2/s$) | | | | | | |
| 40° C. | 12.8 | 12.7 | 15.3 | 15.4 | 11.9 | 11.8 |
| 100° C. | 2.7 | 2.7 | 3.0 | 3.1 | 2.7 | 2.7 |
| Total acid value (mgKOH/g) | 0.00 | 0.00 | 0.00 | 0.00 | 0.00 | 0.00 |
| Miscibility | miscible | miscible | miscible | miscible | miscible | miscible |

TABLE 8-continued

| | Comp. Example 27 | Comp. Example 28 | Comp. Example 29 | Comp. Example 30 | Comp. Example 31 | Comp. Example 32 |
|---|---|---|---|---|---|---|
| Volume resistivity (Ω · cm) | $1.0 \times 10^{12}$ | $1.5 \times 10^{12}$ | $9.9 \times 10^{12}$ | $2.3 \times 10^{13}$ | $1.8 \times 10^{13}$ | $3.4 \times 10^{13}$ |
| Heat/hydrolytic stability I | | | | | | |
| Appearance of sample oil | no change | no change | no change | no change | no change | no change |
| Appearance of catalyst | | | | | | |
| Cu | no change | no change | no change | no change | no change | no change |
| Fe | no change | partially blackened | no change | partially blackened | no change | partially blackened |
| Al | no change | no change | no change | no change | no change | no change |
| Volume resistivity (Ω · cm) | $4.2 \times 10^{11}$ | $4.7 \times 10^{10}$ | $1.8 \times 10^{12}$ | $1.6 \times 10^{11}$ | $3.6 \times 10^{12}$ | $1.2 \times 10^{11}$ |
| Total acid value (mgKOH/g) | 0.32 | 0.84 | 0.45 | 0.78 | 0.69 | 1.15 |
| Lubricity test | | | | | | |
| Wear width (μm) | 405 | 300 | 395 | 310 | 410 | 285 |
| Wear depth (μm) | 2.8 | 1.0 | 2.4 | 1.3 | 2.8 | 0.8 |

TABLE 9

| | Example 17 | Example 18 | Example 19 | Example 20 | Example 21 | Example 22 |
|---|---|---|---|---|---|---|
| Base oil | Base oil 1 | Base oil 2 | Base oil 3 | Base oil 4 | Base oil 5 | Base oil 6 |
| Additive | | | | | | |
| Type | Additive 1 | Additive 1 | Additive 2 | Additive 2 | Additive 3 | Additive 2 |
| Content (% by mass) | 0.2 | 0.2 | 0.2 | 0.2 | 0.2 | 0.2 |
| Kinematic viscosity ($mm^2/s$) | | | | | | |
| 40° C. | 12.3 | 18.2 | 28.5 | 25.6 | 29.5 | 12.7 |
| 100° C. | 2.8 | 3.5 | 4.7 | 4.5 | 4.7 | 2.8 |
| Total acid value (mgKOH/g) | 0.01 | 0.01 | 0.01 | 0.01 | 0.01 | 0.01 |
| Miscibility | miscible | miscible | miscible | miscible | miscible | miscible |
| Volume resistivity (Ω · cm) | $3.3 \times 10^{13}$ | $4.9 \times 10^{13}$ | $8.1 \times 10^{13}$ | $7.9 \times 10^{13}$ | $9.2 \times 10^{12}$ | $3.5 \times 10^{12}$ |
| Heat/hydrolytic stability I | | | | | | |
| Appearance of sample oil | no change | no change | no change | no change | no change | no change |
| Appearance of catalyst | | | | | | |
| Cu | no change | no change | no change | no change | no change | no change |
| Fe | no change | no change | no change | no change | no change | no change |

TABLE 9-continued

| | Example 17 | Example 18 | Example 19 | Example 20 | Example 21 | Example 22 |
|---|---|---|---|---|---|---|
| Al | no change | no change | no change | no change | no change | no change |
| Volume resistivity (Ω · cm) | $1.0 \times 10^{13}$ | $1.1 \times 10^{13}$ | $5.2 \times 10^{13}$ | $6.7 \times 10^{13}$ | $6.3 \times 10^{12}$ | $6.8 \times 10^{11}$ |
| Total acid value (mgKOH/g) | 0.47 | 0.32 | 0.19 | 0.25 | 0.21 | 0.18 |
| Heat/hydrolytic stability II | | | | | | |
| Appearance of sample oil | no change | no change | no change | no change | no change | no change |
| Appearance of catalyst | | | | | | |
| Cu | no change | no change | no change | no change | no change | no change |
| Fe | no change | no change | no change | no change | no change | no change |
| Al | no change | no change | no change | no change | no change | no change |
| Volume resistivity (Ω · cm) | $8.7 \times 10^{12}$ | $8.3 \times 10^{12}$ | $3.2 \times 10^{13}$ | $4.3 \times 10^{13}$ | $5.3 \times 10^{12}$ | $8.7 \times 10^{12}$ |
| Total acid value (mgKOH/g) | 0.97 | 0.82 | 0.34 | 0.38 | 0.29 | 0.41 |

TABLE 10

| | Example 23 | Example 24 | Example 25 | Example 26 | Example 27 | Example 28 |
|---|---|---|---|---|---|---|
| Base oil | Base oil 7 | Base oil 8 | Base oil 9 | Base oil 10 | Base oil 11 | Base oil 12 |
| Additive | | | | | | |
| Type | Additive 2 | Additive 3 | Additive 1 | Additive 2 | Additive 2 | Additive 2 |
| Content (% by mass) | 0.2 | 0.2 | 0.2 | 0.2 | 0.2 | 0.2 |
| Kinematic viscosity ($mm^2/s$) | | | | | | |
| 40° C. | 16.5 | 29.5 | 10.8 | 12.7 | 12.7 | 12.6 |
| 100° C. | 3.3 | 4.7 | 2.6 | 2.7 | 2.7 | 2.8 |
| Total acid value (mgKOH/g) | 0.01 | 0.01 | 0.00 | 0.00 | 0.00 | 0.00 |
| Miscibility | miscible | miscible | miscible | miscible | miscible | miscible |
| Volume resistivity (Ω · cm) | $2.2 \times 10^{13}$ | $3.2 \times 10^{13}$ | $7.5 \times 10^{12}$ | $3.2 \times 10^{13}$ | $3.7 \times 10^{13}$ | $3.6 \times 10^{13}$ |
| Heat/hydrolytic stability I | | | | | | |
| Appearance of sample oil | no change | no change | no change | no change | no change | no change |
| Appearance of catalyst | | | | | | |
| Cu | no change | no change | no change | no change | no change | no change |
| Fe | no change | no change | no change | no change | no change | no change |
| Al | no change | no change | no change | no change | no change | no change |

TABLE 10-continued

| | Example 23 | Example 24 | Example 25 | Example 26 | Example 27 | Example 28 |
|---|---|---|---|---|---|---|
| Volume resistivity (Ω · cm) | $7.9 \times 10^{12}$ | $4.2 \times 10^{12}$ | $4.6 \times 10^{12}$ | $7.8 \times 10^{12}$ | $9.4 \times 10^{12}$ | $8.6 \times 10^{12}$ |
| Total acid value (mgKOH/g) | 0.29 | 0.31 | 0.43 | 0.12 | 0.15 | 0.22 |
| Heat/ hydrolytic stability II | | | | | | |
| Appearance of sample oil | no change | no change | no change | no change | no change | no change |
| Appearance of catalyst | | | | | | |
| Cu | no change | no change | no change | no change | no change | no change |
| Fe | no change | no change | no change | no change | no change | no change |
| Al | no change | no change | no change | no change | no change | no change |
| Volume resistivity (Ω · cm) | $4.7 \times 10^{12}$ | $4.6 \times 10^{12}$ | $2.1 \times 10^{12}$ | $8.3 \times 10^{12}$ | $7.9 \times 10^{12}$ | $9.2 \times 10^{12}$ |
| Total acid value (mgKOH/g) | 0.36 | 0.39 | 0.78 | 0.31 | 0.40 | 0.42 |

TABLE 11

| | Example 29 | Example 30 | Example 31 | Example 32 |
|---|---|---|---|---|
| Base oil | Base oil 13 | Base oil 14 | Base oil 15 | Base oil 16 |
| Additive | | | | |
| Type | Additive 1 | Additive 3 | Additive 3 | Additive 3 |
| Content (% by mass) | 0.2 | 0.2 | 0.2 | 0.2 |
| Kinematic viscosity ($mm^2/s$) | | | | |
| 40° C. | 10.3 | 12.9 | 15.2 | 11.7 |
| 100° C. | 2.5 | 2.7 | 3.0 | 2.6 |
| Total acid value (mgKOH/g) | 0.00 | 0.00 | 0.00 | 0.00 |
| Miscibility | miscible | miscible | miscible | miscible |
| Volume resistivity (Ω · cm) | $1.9 \times 10^{12}$ | $1.2 \times 10^{12}$ | $1.9 \times 10^{13}$ | $2.6 \times 10^{13}$ |
| Heat/ hydrolytic stability I | | | | |
| Appearance of sample oil | no change | no change | no change | no change |
| Appearance of catalyst | | | | |
| Cu | no change | no change | no change | no change |
| Fe | no change | no change | no change | no change |
| Al | no change | no change | no change | no change |
| Volume resistivity (Ω · cm) | $8.4 \times 10^{11}$ | $8.5 \times 10^{11}$ | $5.9 \times 10^{12}$ | $7.3 \times 10^{12}$ |

TABLE 11-continued

| | Example 29 | Example 30 | Example 31 | Example 32 |
|---|---|---|---|---|
| Total acid value (mgKOH/g) | 0.61 | 0.11 | 0.09 | 0.29 |
| Heat/ hydrolytic stability II | | | | |
| Appearance of sample oil | no change | no change | no change | no change |
| Appearance of catalyst | | | | |
| Cu | no change | no change | no change | no change |
| Fe | no change | no change | no change | no change |
| Al | no change | no change | no change | no change |
| Volume resistivity (Ω · cm) | $8.9 \times 10^{11}$ | $6.9 \times 10^{11}$ | $7.9 \times 10^{12}$ | $9.3 \times 10^{12}$ |
| Total acid value (mgKOH/g) | 0.83 | 0.38 | 0.42 | 0.36 |

As shown in Tables 1 to 11, all of the sample oils of Examples 1 to 32 representing refrigerator machine oil compositions of the invention exhibited sufficiently low viscosity and satisfactory balance between refrigerant miscibility, electric insulating property, heat and hydrolytic stability and lubricity, thus confirming their usefulness for providing high efficiency to refrigeration systems. Of the sample oils, those of Examples 17 to 32 using epoxy compounds (additives 1–3) exhibited very excellent heat and hydrolytic stability.

In contrast, the sample oils of Comparative Examples 1 to 32 were inadequate in any aspect including the refrigerant miscibility, electric insulating property, heat and hydrolytic stability and lubricity.

Industrial Applicability

As explained above, the present invention can be used together with HFC refrigerants and natural refrigerants such as carbon dioxide and hydrocarbons, to give a refrigerant machine oil composition with excellent lubricity, miscibility with refrigerants, heat and hydrolytic stability and electric insulating property, which can also provide high efficiency to refrigeration systems.

What is claimed is:

1. A refrigerating machine oil composition comprising an alicyclic dicarboxylic acid ester compound containing an alicyclic ring and two ester groups represented by the following general formula (1):

$$—COOR^1 \quad (1)$$

where $R^1$ represents a hydrocarbon group of 1–30 carbons, said two ester groups bonded to mutually adjacent carbon atoms on the alicyclic ring, wherein the molar ratio of cis-forms and trans-forms for the orientation of said two ester groups of said alicyclic dicarboxylic acid ester compound is from 20/80 to 80/20.

2. A refrigerating machine oil composition according to claim 1, wherein the molar ratio of cis-forms and trans-forms for the orientation of said two ester groups of said alicyclic dicarboxylic acid ester compound is from 25/75 to 75/25.

3. A refrigerating machine oil composition according to claim 1, wherein the molar ratio of cis-forms and trans-forms for the orientation of said two ester groups of said alicyclic dicarboxylic acid ester compound is from 30/70 to 70/30.

4. A refrigerating machine oil composition according to claim 1, which further comprises at least one selected from the group consisting of phosphoric acid esters, acidic phosphoric acid esters, amine salts of acidic phosphoric acid ester, chlorinated phosphoric acid esters and phosphorous acid esters.

5. A refrigerating machine oil composition according to claim 1, which further comprises at least one selected from the group consisting of phenylglycidyl ether-type epoxy compounds, alkylglycidyl ether-type epoxy compounds, glycidyl ester-type epoxy compounds, allyloxirane compounds, alkyloxirane compounds, alicyclic epoxy compounds, epoxidized fatty acid monoesters and epoxidized vegetable oils.

* * * * *